US012320620B2

(12) United States Patent
Otto

(10) Patent No.: US 12,320,620 B2
(45) Date of Patent: Jun. 3, 2025

(54) METHOD AND BACK-UP AIMING CONTROL UNIT FOR OPERATING A BACK-UP AIMING SYSTEM FOR AN ARTILLERY DEVICE, ARTILLERY DEVICE AND VEHICLE

(71) Applicant: VINCORION Advanced Systems GmbH, Wedel (DE)

(72) Inventor: Stephan Otto, Hamburg (DE)

(73) Assignee: Vincorion Advanced Systems, Wedel (DE)

( * ) Notice: Subject to any disclaimer, the term of this patent is extended or adjusted under 35 U.S.C. 154(b) by 0 days.

(21) Appl. No.: 18/282,433

(22) PCT Filed: Mar. 13, 2023

(86) PCT No.: PCT/EP2023/056349

§ 371 (c)(1),
(2) Date: Sep. 15, 2023

(87) PCT Pub. No.: WO2023/174869

PCT Pub. Date: Sep. 21, 2023

(65) Prior Publication Data

US 2025/0035407 A1 Jan. 30, 2025

(30) Foreign Application Priority Data

Mar. 16, 2022 (DE) ..... 10 2022 106 062.4

(51) Int. Cl.
*F41G 5/24* (2006.01)
*F41A 27/20* (2006.01)

(52) U.S. Cl.
CPC ..... *F41G 5/24* (2013.01); *F41A 27/20* (2013.01)

(58) Field of Classification Search
CPC ..... F41G 3/10; F41G 3/18; F41G 5/24; F41A 27/02; F41A 27/00; F41A 27/28; F41A 27/20

(Continued)

(56) References Cited

U.S. PATENT DOCUMENTS 3,055,180 A * 9/1962 Kane ..... F41G 5/04 60/368
4,686,888 A * 8/1987 Sanborn ..... F41A 25/00 89/41.02

(Continued)

FOREIGN PATENT DOCUMENTS

DE 36 13 097 A1 1/1988
DE 10 2013 204 273 83 4/2014
DE 10 2020 211 557 A1 3/2022

*Primary Examiner* — John Cooper

(57) ABSTRACT

A method of operating a back-up aiming system for an artillery device having at least one back-up aiming drive unit and an artillery unit for a vehicle. The back-up aiming system is operated at least in the event of a failure of a main aiming system of the artillery device. An activation signal is provided to an interface to a back-up aiming electronics unit, the activation signal being configured to activate the back-up aiming system. A setpoint signal is read via an interface to a detection device, wherein an alignment signal with a setpoint speed and/or a setpoint torque with respect to a movement of the artillery device is calculated and set from the setpoint signal of the at least one back-up aiming drive unit. At least one alignment signal is outputted for aligning the at least one back-up aiming drive unit after the step of reading.

11 Claims, 3 Drawing Sheets

(58) Field of Classification Search
USPC ..... 89/203
See application file for complete search history.

(56) References Cited

U.S. PATENT DOCUMENTS

| | | | | | |
|---|---|---|---|---|---|
| 4,885,977 | A * | 12/1989 | Kirson | F41G 3/22 | 89/41.09 |
| 9,151,572 | B1 * | 10/2015 | Sieracki | F41G 3/18 | |
| 2003/0183070 | A1 * | 10/2003 | Schneider | F41G 3/323 | 89/203 |
| 2004/0033472 | A1 * | 2/2004 | Varshneya | F41G 3/2688 | 434/23 |
| 2014/0238259 | A1 * | 8/2014 | Son | F42B 4/14 | 102/335 |

* cited by examiner

METHOD AND BACK-UP AIMING CONTROL UNIT FOR OPERATING A BACK-UP AIMING SYSTEM FOR AN ARTILLERY DEVICE, ARTILLERY DEVICE AND VEHICLE

CROSS REFERENCE TO RELATED APPLICATIONS

This nonpprovisional application is a National Stage of International Application No. PCT/EP2023/056349, which was filed on Mar. 13, 2023, and which claims priority to German Patent Application No. 10 2022 106 062.4, which was filed in Germany on Mar. 16, 2022, and which are both herein incorporated by reference.

PRIOR ART

The invention relates to a method and a back-up aiming control unit for operating a backup aiming system for an artillery device, an artillery device and a vehicle according to the genus of the independent claims. The present invention also relates to a computer program.

A main drive of gun turrets is operated electrically or hydraulically in military vehicles. The weapon is tracked to a sighting device, ensuring that the fire control computer adjusts the elevation and lead angle so as to hit the target. In this process, the sighting device remains stabilized on the target, and the main drives track the weapons accordingly.

Against this background, the approach presented herein introduces an improved method and an improved back-up aiming control unit for operating a back-up aiming system for an artillery device, an improved artillery device, an improved vehicle, and finally a corresponding computer program according to the main claims. By the measures listed in the dependent claims, advantageous further developments and improvements of the device indicated in the independent claim are possible.

By the approach presented herein, a possibility is presented to reduce a time duration for aligning an artillery unit using a back-up aiming system.

A method is presented for operating a back-up aiming system for an artillery device having at least one back-up aiming drive unit and an artillery unit for a vehicle connected to the back-up aiming drive unit, wherein the back-up aiming system is operated at least in the event of a failure of a main aiming system of the artillery device. The method comprises a step of providing an activation signal to an interface to a back-up aiming activation unit, the activation signal being adapted to activate the back-up aiming system. In a step of reading, a setpoint signal is read via an interface to a detection device or fire control computer in order to generate an alignment signal from the setpoint signal, the alignment signal providing the at least one back-up aiming drive unit with a setpoint position for a movement of the artillery device or a weapon. Also, the method comprises a step of outputting at least one alignment signal for aligning the at least one back-up aiming drive unit after the step of reading to align the artillery unit with the setpoint speed and/or torque represented by the alignment signal at least during the failure of the main aiming system. Furthermore, the method may include a step of outputting at least one release signal to enable a shot after the step of reading in to safely enable a shot to be fired at the target.

The artillery system may be used, for example, for military vehicles, such as tanks. The back-up aiming system may be operated in an automated manner, for example, such that intervention by a user is not a prerequisite for functionality of the back-up aiming system. The back-up aiming drive unit may be formed, for example, as a motor that may be formed to move an artillery unit of the artillery device. The detection device may, for example, be formed as a sighting device that may be formed to detect, for example, a surrounding area of the vehicle. The aiming position may be, for example, a position at which the artillery unit is to aim. Advantageously, by the approach presented herein, a detected target can be kept in sight continuously using at least one sighting device even if the main aiming system fails.

According to one embodiment, the method may comprise a step of receiving a change signal prior to the step of outputting, wherein the change signal may represent a change in aiming position by a user. Furthermore, in the step of outputting, the change signal may be output to the artillery unit to align the artillery unit with the aiming position changed by the change signal at least during the failure of the main aiming system. Specifically, alignment of the artillery unit with the setpoint speed and/or setpoint torque represented by the alignment signal can be suppressed when a change in the aiming position made by a user has been detected. The change signal may, for example, represent an intervention made manually by the user. Advantageously, a manual intervention can be prioritized higher than an automatically detected aiming position.

In the step of providing the activation signal, the at least one back-up aiming electronic system can be electrically connected to a supply network in response to the activation of the back-up aiming system. Advantageously, this may avoid damage by, for example, a nuclear pulse that may damage, for example, active supply networks.

According to one embodiment, the step of providing the release signal may be performed when the vehicle is stationary. Advantageously, aiming and, for example, stabilization of the artillery unit during a shot is improved. The artillery unit may comprise, for example, a turret and a weapon.

In the step of providing the activation signal, the activation signal may be provided in response to a failure signal representing the failure of the main aiming system.

The approach presented herein further provides a back-up aiming control unit configured to perform, control, or implement the steps of a variant of a method presented herein in corresponding devices. The object underlying the invention can be achieved quickly and efficiently also by this embodiment of the invention in the form of a device.

For this purpose, the back-up aiming control unit may have at least one computing unit for processing signals or data, at least one memory unit for storing signals or data, at least one interface to a sensor or an actuator for reading in sensor signals from the sensor or for outputting data or control signals to the actuator, and/or at least one communication interface for reading in or outputting data embedded in a communication protocol. The computing unit may be, for example, a signal processor, a microcontroller or the like, and the memory unit may be a flash memory, an EEPROM or a magnetic memory unit. The communication interface may be configured to read in or output data wirelessly and/or line-bound, wherein a communication interface that can read in or output line-bound data may, for example, read this data from a corresponding data transmission line or output it to a corresponding data transmission line in an electrical or optical manner.

A back-up control unit can be understood as an electrical device that processes sensor signals and outputs control and/or data signals in dependence thereon. The device may have an interface, which may be configured in terms of hardware and/or software. In the case of a hardware-based configuration, the interfaces may, for example, be part of a so-called system ASIC that contains various functions of the device. However, it is also possible that the interfaces are integrated circuits of their own or consist at least partially of discrete components. In a software-based configuration, the interfaces may be software modules that are present, for example, on a microcontroller alongside other software modules.

Furthermore, an artillery device for a vehicle is presented, wherein the artillery device presents an artillery unit, at least one back-up aiming drive unit connected to the artillery unit, and a back-up aiming control unit in a previously mentioned variant for controlling the back-up aiming drive unit and the artillery unit.

The artillery unit may be used in wartime, for example. The artillery unit may, for example, comprise a weapon and/or a gun turret, the weapon being movably arranged on the turret or gun turret. The back-up aiming drive unit may, for example, comprise at least one motor configured to move the weapon or gun turret.

Furthermore, a vehicle is presented with an artillery device as presented herein.

For example, the vehicle may be configured as a military vehicle, such as a tank.

Embodiments of the approach presented herein are explained in more detail in the following description and are shown in the drawings, wherein.

In the following description of advantageous embodiments of the present invention, the same or similar numerals are used for the elements shown in the various figures and having a similar effect, and repeated description of these elements is omitted.

If an embodiment comprises an "and/or" combination between a first feature and a second feature, this is to be read as meaning that the embodiment comprises both the first feature and the second feature according to one embodiment and either only the first feature or only the second feature according to a further embodiment.

Figure 1:
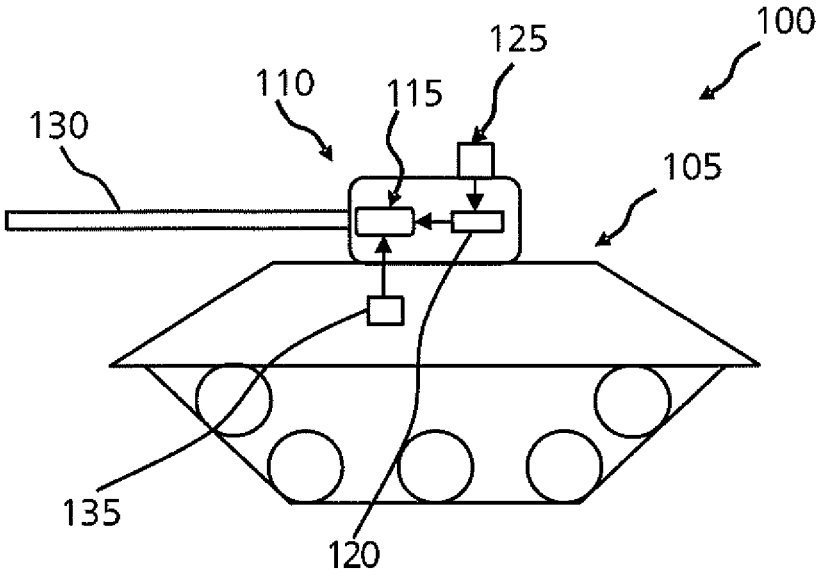
FIG. 1 shows a schematic illustration of a vehicle with an artillery device according to an embodiment.

FIG. 1 shows a schematic illustration of a vehicle 100 with an artillery device 105 according to an embodiment. According to this embodiment example, the vehicle 100 is realized as a tank. For this purpose, the vehicle 100 comprises the artillery device 105, which comprises an artillery unit 110 and at least one back-up aiming drive unit 115 connected to the artillery unit 110. The artillery device 105 further comprises a back-up aiming control unit 120. The back-up aiming control unit 120 is configured, for example, to control the back-up aiming drive unit 115 and thus the artillery unit 110. The back-up aiming control unit 120 is realized, for example, as a controller configured to control or execute a method for operating a back-up aiming system for the artillery device 105, as will be explained in more detail in one of the following figures. According to this embodiment, the vehicle 100 further comprises at least one detection device 125, also referred to as a sighting device, for detecting a surrounding environment of the vehicle 100.

Such a military vehicle 100 generally has a main aiming system as well as a back-up aiming system, which intervenes when the main aiming system falls. This renders the artillery device 105 operational at all times.

In military vehicles 100, the main drive of gun turrets, referred to here as artillery device 105, is operated electrically or hydraulically. In this process, the weapon 130 is tracked to a sighting device, referred to herein as detection device 125, thereby ensuring that a fire control computer adjusts the elevation and lead angle such that an intended target is hit. In doing so, the detection device 125 remains stabilized on the target and the main drive units track the weapon 130 and artillery unit 110 accordingly. If, for example, one or both of the main drive units fail, the artillery device 105 has a back-up aiming drive unit 115, which is either mechanically activated and operated by gunners via a manual back-up aiming control unit 135 or is electrically controlled and activated via an independent back-up aiming control unit. This back-up aiming control unit 115 shall be operational under all conditions. Even a nuclear pulse shall not lead to destruction of the back-up aiming system.

However, with the introduction of unmanned turrets and remotely controlled mounts, it is not possible to integrate mechanical back-up aiming drive units into the artillery device 105. For this reason, electric back-up aiming drive units are mounted in modern systems. These are usually always disconnected from a supply network for protection against a nuclear pulse when they are not in use. If the main drive fails partially or completely due to a fault or a nuclear pulse, the weapon can still be aimed and targets engaged by activating the back-up aiming drive unit.

Therefore, the approach presented herein introduces and describes a means to continue to track the weapon 130 and artillery unit 110 to the detection device 125 when the back-up aiming drive unit is active.

More specifically, an electric back-up aiming drive system is described that masters an operating condition that allows the weapon 130 to track the detection device 125 with the back-up aiming drive unit 115. For this purpose, the electric back-up aiming drive unit 115 can be activated in two ways. Both ways lead to a supply of a back-up aiming drive unit only when required, in order to prevent damage by a nuclear impulse. In a first way, the electronic systems are activated via the manual back-up aiming control unit 135 only when the gunner actuates a switch or the back-up aiming handle of the manual back-up aiming control unit 135. The second way describes that a higher-level back-up aiming control unit can switch on the back-up aiming drive unit via another input without an operator.

The first case describes the well-tried back-up aiming operation, in which the detection device 125 follows the weapon 130. However, this loses the stabilized sight of the target. In the second case, however, it is possible to continue staying on target with the detection device 125 in the event of a failure of the main aiming drive units and/or electronics. To this end, the back-up aiming electronic systems are turned on by the back-up aiming control unit such as a main aiming system or the fire control computer 401. Communication is then established and the back-up aiming drive unit 115 can be controlled such that the weapon 130 follows the detection device 125. For the gunner, nothing changes compared to the operation of the artillery device 105 with fully functional aiming drives. He can use all the sighting devices of the detection device 125 to reconnoiter and sight in on targets even while the vehicle is in motion. To engage, the vehicle 100 is now only to be stopped briefly, because the back-up aiming drives do not have sufficient power to stabilize the weapon while in motion. Once the vehicle 100 has stopped, the weapon 130 runs in on the detection device 125 with the aid of the back-up aiming drive unit, and a shot at the target can immediately be fired.

Since back-up aiming is also active while the vehicle is moving, the time required for the weapon to run in on the detection device 125 is shortened, because the weapon 130 is always aimed in the direction of the detection device 125 even while the vehicle is moving. This approach to integrating an electric back-up aiming drive makes it possible to keep the target continuously in sight with the detection device 125 in the event of failures of the main aiming drive and to reduce to a minimum the standstill times required for aiming at the target with the aid of the back-up aiming drive. Should manual intervention by the gunner be necessary, tracking to the detection device 125 can be interrupted at any time by means of a manual back-up aiming control unit 135. This allows the gunner, in cooperation with the driver, to bring the weapon 130 into rough alignment before the weapon 130 finally runs in on the detection device 125. Operation via the manual back-up aiming control unit 135 thus always has the highest priority and ensures that the gunner always has access to a safe back-up aiming function, even in other cases of failure.

Figure 2:
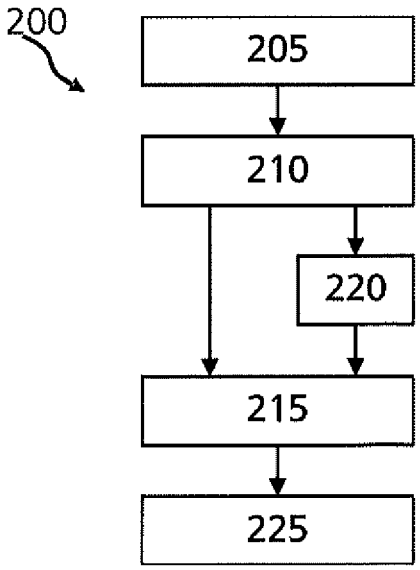
FIG. 2 shows a flowchart of a method for operating a back-up aiming system for an artillery device for a vehicle.

FIG. 2 shows a flowchart of a method 200 for operating a back-up aiming system for an artillery device 105 for a vehicle. For example, the method 200 is executable in a vehicle 100 as described in FIG. 1. The back-up aiming system is operated at least in the event of a failure of a main aiming system of the artillery device 105, so that the artillery device 105 is operational at all times. The back-up aiming system is controlled in an automated manner by the back-up aiming control unit 120, such as described in FIG. 1. The method 200 comprises a step 205 of providing an activation signal to an interface to a back-up aiming activation unit, the activation signal being configured to activate the back-up aiming system. In a step 210 of reading, the position of the detection device 125 is read accordingly via an interface in order to calculate a setpoint signal therefrom. The setpoint signal provides the at least one back-up aiming drive unit with one or more setpoint torques or setpoint speeds with respect to a movement of the artillery unit and/or the weapon. Furthermore, the method 200 comprises a step 215 of outputting at least one alignment signal or control signal for aligning the at least one back-up aiming drive unit after the step 210 of reading, in order to move the artillery unit to the aiming speed or at the setpoint torque represented by the setpoint signal at least during the failure of the main aiming system.

According to this embodiment, the activation signal is provided in the step 205 of providing in response to a failure signal representing the failure of the main aiming system. Furthermore, optionally, in the step 205 of providing, the back-up aiming drive unit is electrically connected to a supply network in response to activating the back-up aiming system. This ensures, for example, that the artillery device remains operational. According to this embodiment, the method 200 comprises a step 220 of reading a change signal prior to the step 215 of outputting. Here, the change signal represents a change in the setpoint signal by a user who, for example, operates the back-up aiming handle of the manual back-up aiming control unit of the vehicle. This means that the change is only optionally initiated manually.

In this case, the alignment signal is output using the change signal to align the artillery unit with the weapon speed changed by the change signal, at least during the failure of the main alignment system. Herein, such manual intervention by the user has higher priority than the setpoint speeds or setpoint torques specified using the sighting device. Furthermore, the method 200 comprises a step 225 of providing a release signal for firing the artillery unit when the weapon is properly aligned and the vehicle has stopped moving.

In other words, the approach presented herein describes a method 200 for weapon tracking using back-up aiming drives with the release for firing when the vehicle is stationary.

Figure 3:
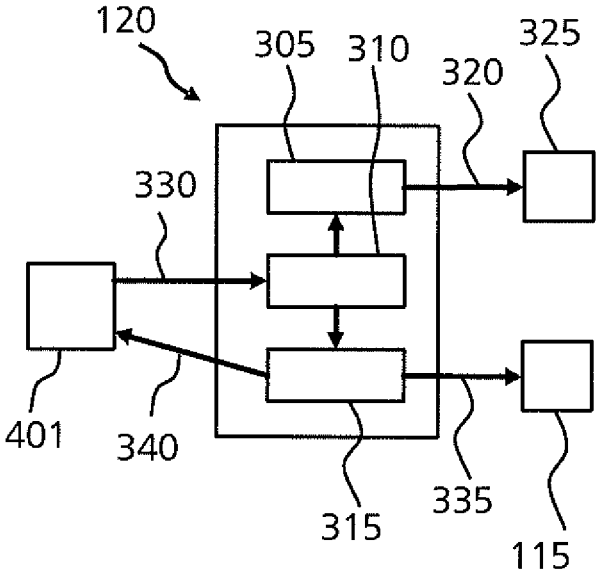
FIG. 3 shows a block diagram of a back-up aiming control unit according to an embodiment.

FIG. 3 shows a block diagram of a back-up aiming control unit 120 according to an embodiment. The back-up aiming control unit 120 corresponds, for example, to the back-up aiming control unit 120 described in FIG. 1 and is configured, for example, to control a method for operating a back-up aiming system for an artillery device for a vehicle as described, for example, in FIG. 2. For this purpose, the back-up aiming control unit 120 comprises a providing unit 305, a reading unit 310, and an output unit 315. The providing unit 305 is configured to effect an activation signal 320 to an interface to a back-up aiming activation unit 325, wherein the activation signal 320 is configured to activate the back-up aiming system. The reading unit 310 is configured to read a setpoint signal 330 via an interface to a fire control computer or stabilization computer 401, wherein the setpoint signal 330 indicates to the at least one back-up aiming drive unit a setpoint speed or setpoint torque for a change in the artillery unit and/or the weapon. The output unit 315 is configured to output at least one alignment signal 335 for aligning the at least one back-up aiming drive unit 115 after reading the setpoint signal 330. Thereby, the artillery unit is aligned with the setpoint speed and/or setpoint torque represented by the alignment signal 335 at least during the failure of the main aiming system.

It should also be noted that the back-up aiming control unit may be part of a stabilization unit or a fire control computer. In this case, it provides the back-up aiming control unit with speed or torque setpoints, for example, which cause the weapon 130 to follow the sighting device 125 while taking the elevation and lead angles into account. If the gunner presses the button on the aiming handle, the gunner can now disable these presets at any time and preset the speed to the back-up aiming control unit himself. A stabilization unit or fire control computer is thus overridden by the gunner.

Figure 4:
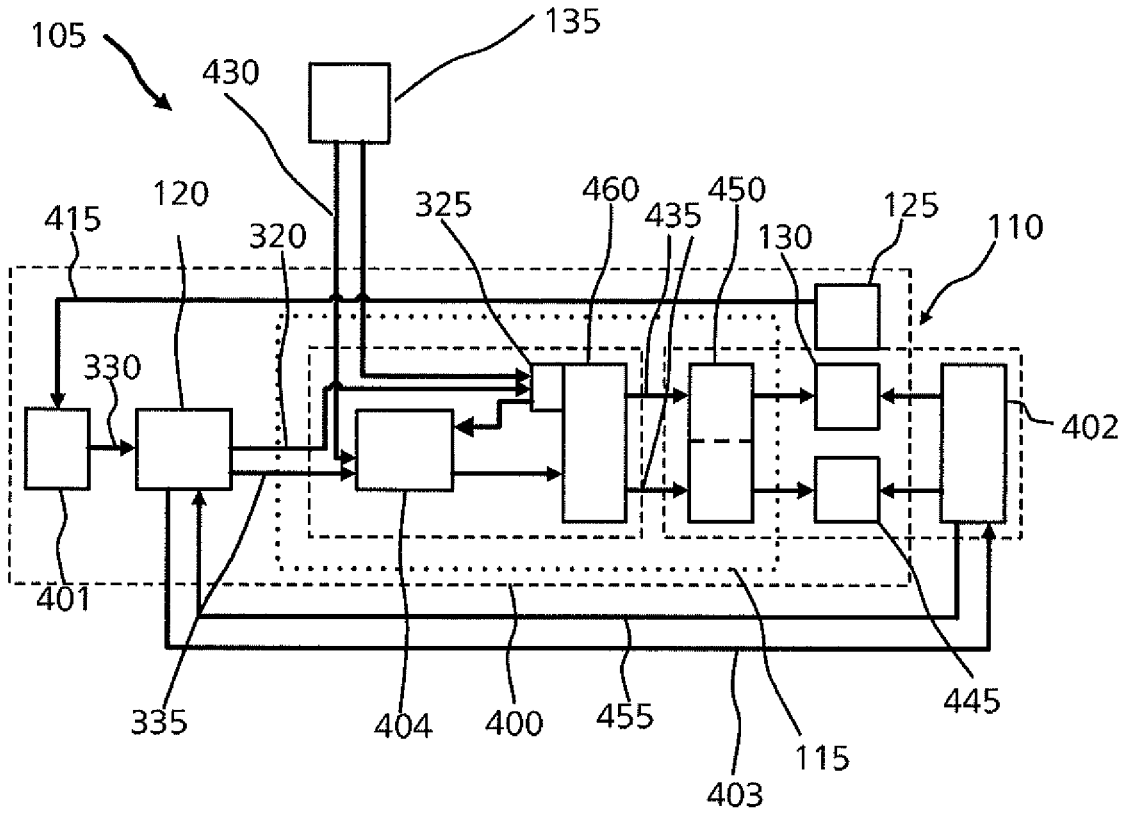
FIG. 4 shows an embodiment of a block diagram for an artillery device for a vehicle.

FIG. 4 shows an embodiment of a block diagram for an artillery device 105 for a vehicle 100. According to this embodiment, the block diagram illustrated here shows a schematic structure of components used to perform and/or control a method for operating a back-up artillery system 400 as described in FIG. 3. For example, the artillery device 105 includes a fire control computer 401 configured to add ballistic setpoints to the setpoint signals 415 of the detection device 125 and to feed these new setpoint signals 330 to a back-up aiming control unit. The back-up aiming control unit 120 includes a stabilization computer configured to track the gun turret unit 110 and the weapon 130 to the setpoints 330, for example by controlling a main aiming system 402 using a control signal 403.

In doing so, the fire control computer 401 calculates elevation and lead and specifies higher-level modes of operation. The back-up aiming control unit 120, which operates as a stabilization control unit, then performs the control while outputting the activation signal 320, the alignment signal 335, and taking into account other signals and sensor values, for example the failure signal 455 or the setpoint signal 330. For this purpose, the back-up aiming control unit 120 has a back-up aiming controller 404 and a back-up aiming electronics unit 325, which regulates and implements the control of the back-up aiming motors 450.

The back-up aiming control unit 120 is configured to activate the back-up aiming drive unit 115 using an activation signal 320 and a back-up aiming activation unit 325. Furthermore, the back-up aiming drive unit 115 is configured to read an alignment signal 335 via an interface to the back-up aiming control unit 120 in response to the activation signal 320. From the setpoint signal 330, the back-up aiming control unit 120 calculates an alignment signal 335 for at least one back-up aiming drive unit 115. In response thereto, the back-up aiming control unit 120 outputs at least one alignment signal 335 for aligning the at least one backup aiming drive unit 115, in order to align the artillery unit 110 with the setpoint speed and/or the setpoint torque represented by the alignment signal 335 at least during the failure of the main aiming system 402, which for example is also formed as a main aiming drive. Furthermore, a change signal 430, which overrides the alignment signal 335, can be provided to the back-up aiming unit 115 by the gunner via the manual back-up aiming control unit 135. The change signal 430 represents, for example, a manual change of the aiming position by a user. Furthermore, the back-up aiming control unit 120 is configured to provide at least one release signal 340 to the fire control computer 401. The artillery unit 110 has, for example, a weapon 130 and a turret 445 that are controlled by the back-up aiming drive unit 115. The back-up aiming drive unit 115 comprises, for example, at least one motor 450 driven by the back-up aiming electronics 460 via motor control signals 435.

LIST OF REFERENCE NUMERALS

100 vehicle
105 artillery device
110 artillery unit/turret
115 back-up aiming drive unit
120 back-up aiming control unit
125 detection device
130 weapon
135 manual back-up aiming control unit
200 method
205 providing activation signal
210 reading setpoint signal
215 outputting
305 providing unit
310 reading unit
315 output unit
320 activation signal
325 back-up aiming activation unit
330 setpoint signal
335 alignment signal
340 release signal
400 back-up aiming system
401 fire control computer
402 main aiming system
403 control signal
404 back-up aiming controller
415 setpoint signal
430 change signal
435 control signal
445 turret
450 back-up aiming motors
455 failure signal
460 back-up aiming electronics

The invention claimed is:

1. A method of operating a back-up aiming system for an artillery device having at least one back-up aiming drive unit and an artillery unit for a vehicle connected to the back-up aiming drive unit, the back-up aiming system being operated at least in the event of a failure of a main aiming system of the artillery device, the method comprising the steps of:

providing an activation signal to an interface to a back-up aiming electronics unit, wherein the activation signal is configured to activate the back-up aiming system;

reading a setpoint signal via an interface to a fire control computer to generate an alignment signal from the setpoint signal, the alignment signal providing the at least one back-up aiming drive unit with a setpoint speed and/or a setpoint torque with respect to a change of the artillery device; and outputting at least one alignment signal for aligning the at least one back-up aiming drive unit after the step of reading to align the artillery unit with the setpoint speed and/or the setpoint torque represented by the alignment signal at least during the failure of the main alignment system.

2. The method according to claim 1, comprising a step of reading a change signal before the step of outputting, wherein the change signal represents a change of the aiming position by a user, and wherein in the step of outputting, the change signal is output to the artillery unit to align the artillery unit with the aiming position changed by the change signal at least during the failure of the main aiming system, in particular wherein alignment of the artillery unit with the setpoint speed and/or the setpoint torque represented by the alignment signal is suppressed if a change of the aiming position intended by a user has been detected.

3. The method according to claim 1, wherein the at least one back-up aiming drive unit is electrically connected to a supply network in the step of providing the activation signal in response to activating the back-up aiming system.

4. The method according to claim 1, comprising a step of providing a release signal after said step of outputting.

5. The method according to claim 4, wherein the step of providing the release signal is performed when the vehicle is stationary.

6. The method according to claim 1, wherein in the step of providing the activation signal, the activation signal is provided in response to a failure signal representing the failure of the main aiming system (402).

7. A computer program configured to execute and/or control the steps of the method (200) according to claim 1.

8. A machine-readable storage medium, on which the computer program according to claim 7 is stored.

9. A back-up aiming control unit, configured to execute and/or control the steps of the method according to claim 1 in corresponding units.

10. An artillery device for a vehicle, the artillery device comprising:

an artillery unit;

at least one back-up aiming drive unit connected to the artillery unit; and a back-up aiming control unit according to claim 9 for controlling the back-up aiming drive unit and the artillery unit.

11. A vehicle comprising an artillery device according to claim 10.

* * * * *